US011391033B2

(12) United States Patent
Gosling

(10) Patent No.: US 11,391,033 B2
(45) Date of Patent: Jul. 19, 2022

(54) STRUCTURAL COMPONENT FOR MODULAR WALLS

(71) Applicant: DIRTT ENVIRONMENTAL SOLUTIONS LTD., Calgary (CA)

(72) Inventor: Geoff William Gosling, Calgary (CA)

(73) Assignee: DIRTT ENVIRONMENTAL SOLUTIONS LTD.

( * ) Notice: Subject to any disclaimer, the term of this patent is extended or adjusted under 35 U.S.C. 154(b) by 0 days.

(21) Appl. No.: 17/287,090

(22) PCT Filed: Jan. 30, 2020

(86) PCT No.: PCT/US2020/015852
§ 371 (c)(1),
(2) Date: Apr. 20, 2021

(87) PCT Pub. No.: WO2020/160249
PCT Pub. Date: Aug. 6, 2020

(65) Prior Publication Data

US 2021/0388598 A1 Dec. 16, 2021

Related U.S. Application Data

(60) Provisional application No. 62/800,223, filed on Feb. 1, 2019.

(51) Int. Cl.
*E04B 1/24* (2006.01)
*E04B 2/78* (2006.01)

(52) U.S. Cl.
CPC ..... *E04B 1/2403* (2013.01); *E04B 2/78* (2013.01); *E04B 2001/2469* (2013.01)

(58) Field of Classification Search
CPC ... E04B 1/2403; E04B 2/78; E04B 2001/2469
See application file for complete search history.

(56) References Cited

U.S. PATENT DOCUMENTS 6,601,349 B1 8/2003 Corden
8,286,394 B2 * 10/2012 Grossman ..... E04H 7/30 52/194

(Continued)

FOREIGN PATENT DOCUMENTS

FR 2287608 5/1976
WO 2014053004 4/2014

OTHER PUBLICATIONS

International Search Report and Written Opinion for PCT/US2020/015852 dated May 20, 2020.

*Primary Examiner* — Patrick J Maestri
(74) *Attorney, Agent, or Firm* — Workman Nydegger

(57) ABSTRACT

A reversible structural component for use as a portion of a vertical frame in a modular wall system includes an elongate body extending between a first end and a second end thereof, a plurality of countersunk through-holes extending through the structural component, and a plurality of threaded through-holes extending through the structural component. The countersunk through-holes and the threaded through-holes are disposed on the elongate body between the first end and the second end so that the countersunk through-holes of the structural component are aligned with the threaded through-holes of a separate identical structural component when back sides of the structural component and the separate identical structural component are brought together 180-degrees relative to one another during use.

20 Claims, 9 Drawing Sheets

(56) References Cited

U.S. PATENT DOCUMENTS

| | | | | |
|---|---|---|---|---|
| 9,315,985 | B2 * | 4/2016 | Gosling | E04B 2/7414 |
| 2011/0023411 | A1 | 2/2011 | Grossman et al. | |
| 2015/0315788 | A1 * | 11/2015 | Vanker | E04C 5/162<br>403/24 |

* cited by examiner

STRUCTURAL COMPONENT FOR MODULAR WALLS

CROSS-REFERENCE TO RELATED APPLICATIONS

This application is a 371 US nationalization of PCT Patent Application No. PCT/US2020/015852, filed Jan. 30, 2020, which claims priority to U.S. provisional patent application No. 62/800,223, filed Feb. 1, 2019. The entire content of the aforementioned patent applications is incorporated herein by reference.

BACKGROUND

Technical Field

The present invention relates generally to systems, methods, and apparatus for forming, assembling, and installing modular wall systems. More specifically, the present invention relates to structural frame components for modular walls.

Background and Relevant Art

Office space can be relatively expensive, not only due to the basic costs of the location and size of the office space, but also due to any construction needed to configure the office space in a particular way. Furthermore, as an organization's needs change, the organization may need to have a convenient and efficient means to reconfigure the existing office space rather than having to move to a new office space. Many organizations address their configuration and reconfiguration issues by dividing large, open office spaces into individual work areas using modular wall systems.

Modular wall systems are relatively easy to configure and/or reconfigure and can be less expensive to set up than more permanently constructed office dividers. Manufacturers or designers typically design such modular walls and partitions to include a series of individual wall panels (sometimes referred to as "tiles") that can be assembled together to form a range of different configurations. These wall panels are usually connected to one or more structural components that form a frame-type structure of the modular wall.

Modular wall systems used to divide larger or complex spaces tend to utilize a large number of panels and structural components. Due to variations in the geometry and size of different office spaces, designers or installers may need to employ a large number of differently sized structural components suited for specific locations within the wall system. Often, one structural component designed to be placed in one part of a structural frame may not be configured to be placed in another part of the frame. For example, a modular wall system may require different vertical structural components for connecting to various horizontal structural components and/or wall tiles at various orientations/positions. Vertical structural components may thus include numerous different complementary components to facilitate connection to various other structures of a modular wall system, which must be separately manufactured. For instance, a modular wall system may include one type of fastener for fastening a vertical structure to another vertical structure and may include a different type of fastener for fastening a vertical structure to a horizontal structure (e.g., for receiving wall tiles).

The need for a large number of unique structural components within a modular wall system increases costs for the manufacturer, and thus the end user. This is at least in part because separate molds and extrusions must be created to form the wide variety of unique structural components that may be needed in any one modular wall system.

Accordingly, there are a number of problems in the field of modular wall systems that can be addressed.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

The present disclosure relates to systems, methods, and apparatus associated with structural components of modular wall systems. For example, the present invention can include reversible structural components that may combine together when rotated 180-degrees relative to one another to form at least a portion of a vertical frame in a modular wall system. The present invention can also include a vertical frame for use in a modular wall system that has first and second structural components that each include through-hole pairs with countersunk and threaded through-holes. The threaded through-holes of the first structural component can align with the countersunk through-holes of the second structural component, and the threaded through-holes of the second structural component can align with the countersunk through-holes of the first structural component to form the vertical frame for use in a modular wall system. Accordingly, implementations of the present invention can provide structural components formed from the same molds/extrusions and that are combinable with one another to form frame components of modular wall systems, thereby at least partially simplifying the manufacturing process for creating frame components for modular wall systems.

In at least one of the presently disclosed embodiments, a reversible structural component for use as a portion of a vertical frame in a modular wall system includes an elongate body extending between a first end and a second end thereof, a plurality of countersunk through-holes extending through the structural component, and a plurality of threaded through-holes extending through the structural component. The countersunk through-holes and the threaded through-holes are disposed on the elongate body between the first end and the second end so that the countersunk through-holes of the structural component are aligned with the threaded through-holes of a separate identical structural component when back sides of the structural component and the separate identical structural component are brought together 180-degrees relative to one another during use.

In another aspect of the presently disclosed embodiments, a vertical frame for use in a modular wall system includes a first structural component and a second structural component. Each of the first and second structural components includes an elongated body (which includes a front side and a back side) and a through-hole pair. The through-hole pair includes a countersunk through-hole and a threaded through-hole that are offset from one another. When the back side of the first structural component abuts the back side of the second structural component, the countersunk through-hole of the through-hole pair of the first structural component becomes aligned with the threaded through-hole of the through-hole pair of the second structural component, and the threaded through-hole of the through-hole pair of the first structural component becomes aligned with the countersunk through-hole of the through-hole pair of the second structural component.

In yet another aspect of the presently disclosed embodiments, a modular wall includes at least a first and a second elongate structural component joined together 180-degrees relative to one another at respective back sides thereof. Each elongate structural component can include a plurality of countersunk through-holes extending therethrough and a plurality of threaded through-holes extending therethrough. The positions of each of the plurality of countersunk through-holes and the positions of each of the plurality of threaded through-holes are the same along a length of each of the first and second elongate structural components, respectively, so that the countersunk through-holes of each of the first and second elongate structural components are aligned with the threaded through-holes of the other elongate structural component to which it is joined. The threaded through-holes of each of the first and second elongate structural components can also be aligned with the countersunk through-holes of the other elongate structural components to which it is joined. The modular wall can also include a horizontal connection component affixed to the first elongate structural component. The horizontal connection component can further include an attachment feature for receiving a modular wall tile. Still further, the modular wall can include a modular wall tile attached to the attachment feature.

This summary is provided to introduce a selection of concepts in a simplified form that are further described below in the detailed description. This summary is not intended to identify key features or essential features of the claimed subject matter, nor is it intended to be used as an indication of the scope of the claimed subject matter.

Additional features and advantages of the disclosure will be set forth in the description which follows, and in part will be obvious from the description, or may be learned by the practice of the disclosure. The features and advantages of the disclosure may be realized and obtained by means of the instruments and combinations particularly pointed out in the appended claims. These and other features of the present disclosure will become more fully apparent from the following description and appended claims, or may be learned by the practice of the disclosure as set forth hereinafter.

BRIEF DESCRIPTION OF THE DRAWINGS

In order to describe the manner in which the above recited and other advantages and features of the disclosure can be obtained, a more particular description of the disclosure briefly described above will be rendered by reference to specific embodiments thereof, which are illustrated in the appended drawings. It is appreciated that these drawings depict only typical embodiments of the disclosure and are not therefore to be considered to be limiting of its scope. The disclosure will be described and explained with additional specificity and detail through the use of the accompanying drawings in which.

DETAILED DESCRIPTION

Figure 1A:
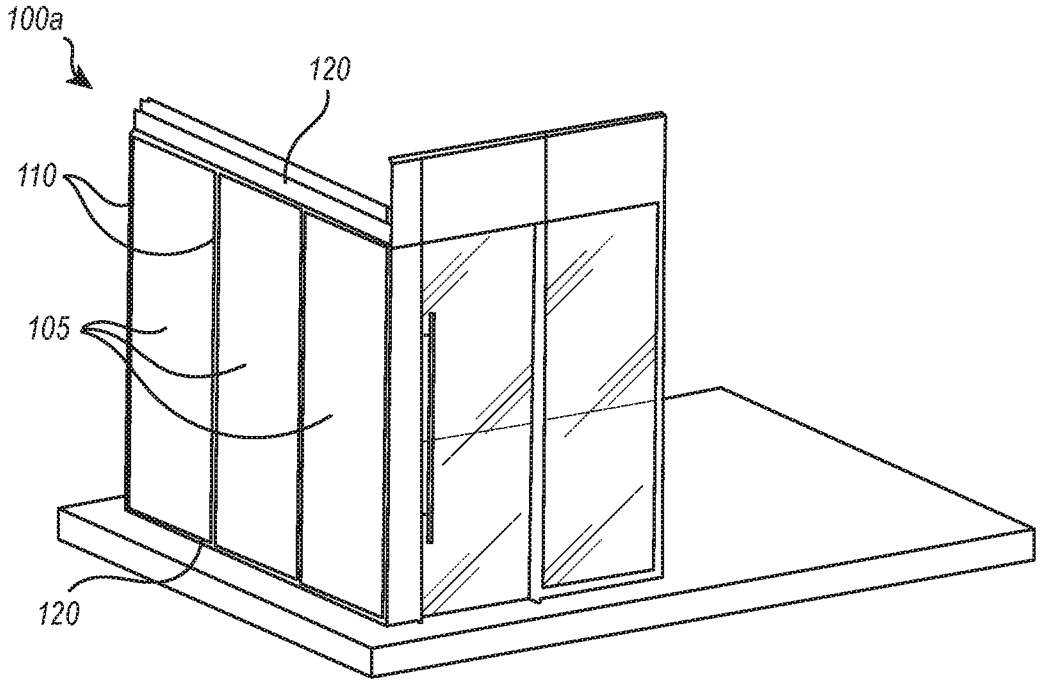
FIGS. 1A and 1B illustrate examples of modular wall systems including a number of modular wall panels in accordance with implementations of the present invention.

Implementations of the present invention extend to systems, methods, and apparatus for forming, assembling, and/or installing modular wall systems. More specifically, the present invention relates to structural frame components for modular walls. For example, in one implementation of the present disclosure, a reversible structural component for use as a portion of a vertical frame in a modular wall system includes an elongate body extending between a first end and a second end thereof, a plurality of countersunk through-holes extending through the structural component, and a plurality of threaded through-holes extending through the structural component. The countersunk through-holes and the threaded through-holes are disposed on the elongate body between the first end and the second end so that the countersunk through-holes of the structural component are aligned with the threaded through-holes of a separate identical structural component when back sides of the structural component and the separate identical structural component are brought together 180-degrees relative to one another during use.

In some embodiments, the reversible structural component includes a second plurality of countersunk through-holes. At least one of the second plurality of countersunk through-holes is configured to align with a threaded hole of a horizontal connection component. At least one of the second plurality of countersunk through-holes is configured to receive a first type of screw to secure the structural component to the horizontal connection component, and the plurality of countersunk through holes and the plurality of threaded through-holes are configured to receive the first type of screw to secure the structural component to the separate identical separate structural component.

The implementations of structural components for modular wall systems described herein may solve a number of problems in the art noted above. For example, in one or more implementations of the structural components described herein, identical structural components can be formed from the same molds or extrusions and applied in different orientations as part of a modular wall system. According to the present disclosure, differently sized molds and/or extrusions may be easily formed to accommodate different modular wall installation sites, based on the simplified form factor of the structural components disclosed herein. Additionally, in some implementations, manufacturers or designers may easily configure structural components for affixation to different arrangements of other modular wall components (e.g., other structural components and/or horizontal connection components) simply by selective placement of countersunk and/or threaded holes. In this regard, molds or extrusions may be configured to fit into different portions of a modular wall system, even when the molds or extrusions are initially the same after extrusion/molding. Furthermore, structural components of the present disclosure may, in some implementations, be affixed to other structural components and/or horizontal connection components with a single type of fastener, ameliorating the need for diverse types of fasteners for affixing different types of structural components to one another in a modular wall system.

Having just described some of the various high-level features and benefits of the disclosed embodiments, attention will now be directed to FIGS. 1A through 8. These Figures illustrate various conceptual representations, architectures, methods, examples, and supporting illustrations related to structural components for modular wall systems.

Figure 1B:
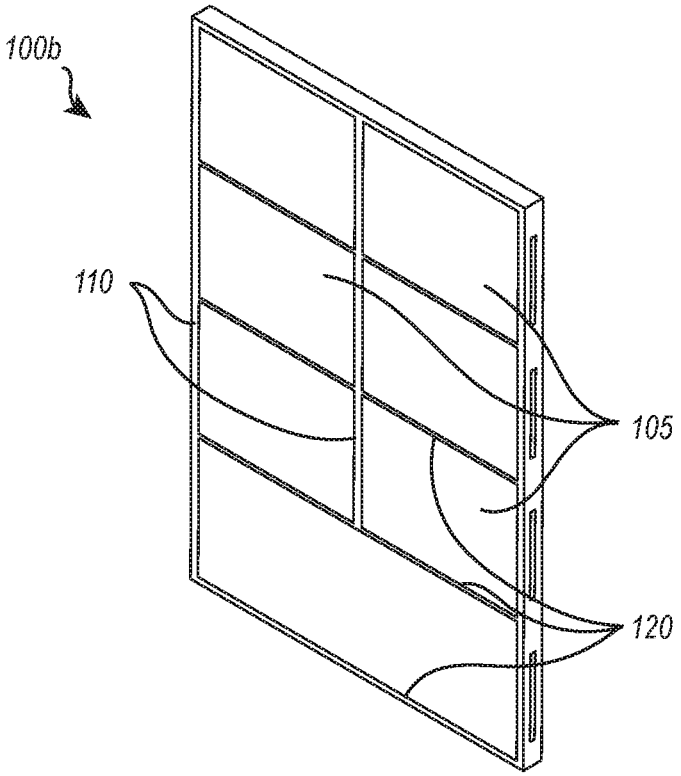

For example, FIGS. 1A and 1B illustrate examples of modular wall systems including a number of modular wall panels. In particular, FIG. 1A illustrates modular wall system 100*a*, and FIG. 1B illustrates modular wall system 100*b*. Each of modular wall system 100*a* and 100*b* include a number of wall tiles 105 secured to vertical structural components 110 and/or horizontal connection components 120. The vertical structural components 110 and/or horizontal connection components 120 may be disposed between adjacent wall tiles 105 or along an edge of the modular wall systems 100*a*, 100*b*.

Figure 2:
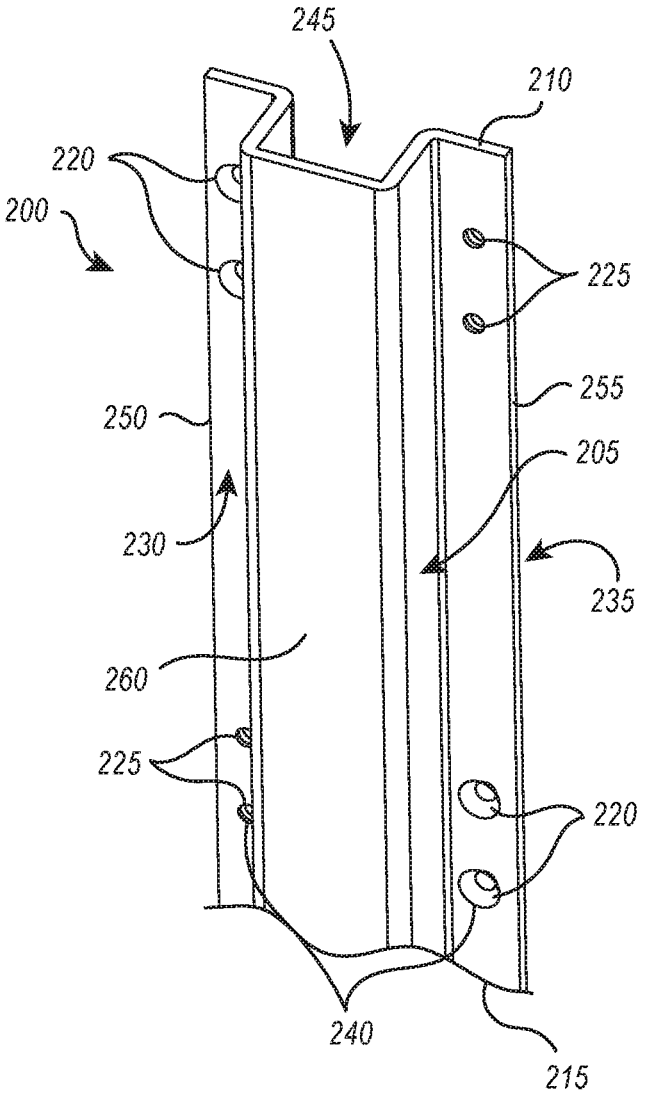
FIG. 2 illustrates a front perspective view of a structural component of a modular wall system, in accordance with implementations of the present invention.

The various components of the modular wall systems 100*a* and 100*b* may be selectively attachable to one another to form a partitioning structure. For example, FIG. 2 shows that the horizontal connection components 120 and/or the vertical structural components 110 may include one or more fastening features for attaching to one another, and the horizontal connection components 120 (and/or the vertical structural components 110, in some instances) may include one or more attachment features for removably securing to one or more wall tiles 105 (e.g., clips, snaps, hooks, channels, etc.). In this regard, the modular wall systems 100*a* and 100*b* may provide a wall system that can be easily assembled, disassembled, rearranged, and/or reconfigured for non-permanent portioning of spaces, such as office spaces. Accordingly, manufacturers, builders, and/or designers may move and/or rearrange entire walls and/or remove, replace, and/or rearrange individual wall tiles 105 to create various customized spaces or aesthetic appearances.

One will appreciate that the modular wall systems of FIGS. 1A and 1B may take on various forms and/or configurations. For instance, modular wall systems may include wall tiles, horizontal components, and/or vertical components that are implemented with different sizes and/or orientations. As noted above, many modular wall systems suffer from a number of shortcomings, such as, for example, requiring different fastening features for facilitating attachment between vertical structural components and/or horizontal connection components, which may give rise to manufacturing and/or design complexities.

FIG. 2 illustrates a front perspective view of an example of a structural component 200. As described herein, builders, manufacturers, and/or designers may implement a structural component of the present disclosure (e.g., structural component 200) into a modular wall system to solve one or more problems associated with modular wall systems described herein.

For example, FIG. 2, shows that the structural component 200 includes an elongated body 205 extending between a first end 210 and a second end 215 of the structural component 200. FIG. 2 further illustrates that the termination of the second end 215 of the structural component 200 is indeterminant, indicating that the elongated body 205 may extend for any distance between the first end 210 and the second end 215 (e.g., along a longitudinal axis of the structural component, the longitudinal axis extending from the first end 210 to the second end 215), within the scope of the present disclosure.

FIG. 2 also illustrates that the structural component 200 includes a number of countersunk through-holes 220 as well as a number of threaded through-holes 225. Both the countersunk through-holes 220 and the threaded through-holes 225 extend through the structural component 200 between a front face 230 and a back face 235 of the structural component. As illustrated in FIG. 2, the countersunk through-holes 220 of the structural component 200 are countersunk from the front face 230 (e.g., front side) of the structural component 200. As will be described in more detail hereinbelow, providing countersunk through-holes 220 that are countersunk from the front face 230 of the structural component 200 can allow the structural component 200 to receive a screw to secure to another structural component 200.

In addition, FIG. 2 illustrates that each countersunk through-hole 220 can be offset from each threaded through-hole 225 in a transverse direction (e.g., offset from one another along a transverse axis that is orthogonal to the longitudinal axis). In this regard, one may consider a through-hole pair 240 to include a countersunk through-hole 220 that is aligned with a threaded through-hole 225 along the transverse axis. The structural component 200 shown in FIG. 2 includes four through-hole pairs 240. Nevertheless, one will appreciate in view of the present specification and claims that a structural component may include any number of through-hole pairs 240 positioned at any location along the longitudinal axis of the structural component 200.

FIG. 2 further illustrates that, in some embodiments, a structural component 200 can include a channel 245 extending longitudinally along the elongated body 205 of the structural component 200. As shown, structural component 200 comprises channel 245 formed on the back face 235 (opposite the front face) thereof, and two opposing flanges, a first flange 250 and a second flange 255, extend outward laterally from opposite sides of the channel 245. In the embodiment depicted in FIG. 2, two of the countersunk through-holes 220 of the structural component 200 are positioned on the first flange 250, and two of the countersunk through-holes 220 are positioned on the second flange 255. Similarly, FIG. 2 shows that two of the threaded through-holes 225 of the structural component 200 are positioned on the first flange 250, and two of the threaded through-holes 225 are positioned on the second flange 255.

In view of the arrangement shown in FIG. 2, one will appreciate that both the first flange 250 and the second flange 255 can include any number countersunk through-holes 220 and/or threaded through-holes 225. Furthermore, one will appreciate in view of the present specification and claims that in at least some other embodiments, all countersunk through-holes 220 of the structural component 200 are positioned on either the first flange 250 or the second flange 255, while all of the threaded through-holes 225 of the structural component are positioned on the other of either the first flange 250 or the second flange 255 (see FIGS. 5A and 5B). Positioning all of the countersunk through-holes 220 on one flange may advantageously enable a simplified installation process and allow an installer to avoid alternating between flanges when inserting screws from the front face of the structural component, as will be described in more detail hereinafter.

As will be described in more detail with reference to FIGS. 4, 6A, and 6B, in some instances, the channel 245 of the structural component 200 may allow the structural component 200 to provide support against lateral forces when an assembler implements the structural component into a modular wall system (e.g., when the structural component is secured to one or more horizontal connection components).

For example, the channel in the back face 235 of the structural component 200 may cause the front face 230 to include a protruding portion 260. A user (e.g., a builder, manufacturer, designer, proprietor, etc.) may affix a horizontal connection component about the protruding portion 260, such that connection surfaces of the horizontal connection component interface with more than one side of the protruding portion 260 of the structural component 200, thereby providing additional support against lateral forces applied to the horizontal connection component (or other portions of a modular wall system).

Figure 3A:
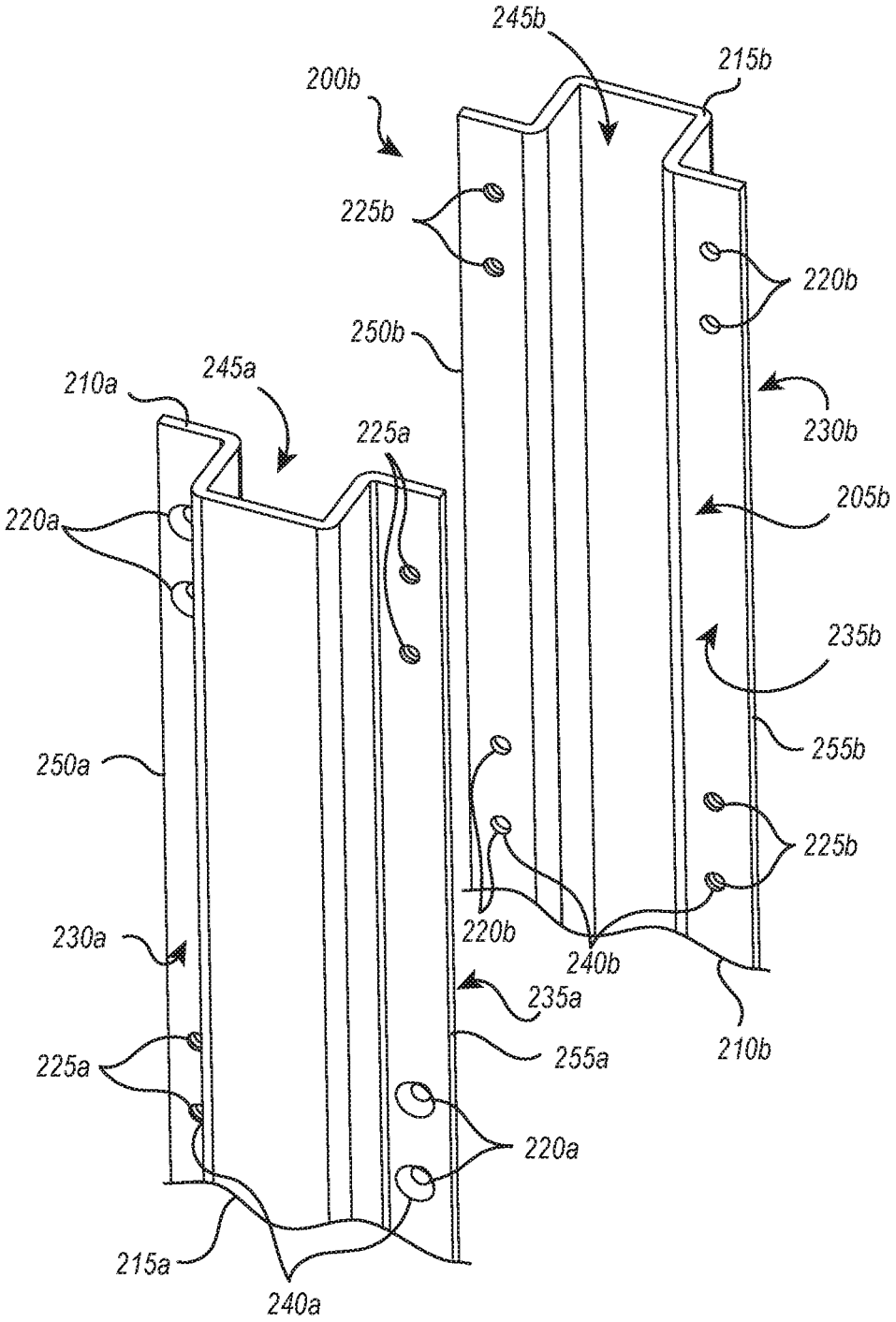
FIG. 3A illustrates a front perspective view of two structural components of a modular wall system, in accordance with implementations of the present invention.

FIG. 3A illustrates a front perspective view of two structural components, a first structural component 200*a* and a second structural component 200*b*, which a manufacturer or assembler can implement into a modular wall system. The structural components 200, 300 shown in FIG. 3A correspond to the structural component 200 illustrated in and described with reference to FIG. 2. As such, those skilled in the art will recognize that both of the structural components 200*a* and 200*b* shown in FIG. 3A may be identical (e.g., substantially identical, accounting for manufacturing tolerances and variance), such that a manufacturer/designer may advantageously form the elongated bodies 205*a*, 205*b* of both structural components 200*a*, 200*b* utilizing the same extrusion or molding process.

FIG. 3A shows that the countersunk through-holes 220*a* and the threaded through-holes 225*a* of the first structural component 200*a* and the countersunk through-holes 220*b* and the threaded through-holes 225*b* of the second structural component 200*b* are identically positioned along the respective lengths of the elongated bodies 205*a*, 205*b* of the structural components 200*a*, 200*b* (e.g., in arrangements of through-hole pairs 240*a*, 240*b*). FIG. 3A also illustrates an arrangement of the first and second structural components 200*a*, 200*b* wherein the back face 235*a* of the first structural component 200*a* faces toward the back face 235*b* of the second structural component 200*b*, such that the second structural component 200*b* is in a rotated or reversed orientation with respect to the orientation of the first structural component 200*a*.

Those skilled in the art will recognize that users may achieve the rotated/reversed orientation of the first and second structural components 200*a*, 200*b* depicted in FIG. 3A in a variety of ways. For example, as shown in FIG. 3A, the first end 210*a* of the first structural component 200*a* is arranged to align with the second end 215*b* of the second structural component 200*b* when the back faces 235*a*, 235*b* of the first and second structural components 200*a*, 200*b* advance into abutment with one another (see FIG. 3B). Similarly, the second end 215*a* of the first structural component 200*a* is arranged to align with the first end 210*b* of the second structural component 200*b* when the back faces 235*a*, 235*b* of the first and second structural components 200*a*, 200*b* advance into abutment with one another (see FIG. 3B).

In this regard, beginning with both structural components in a common orientation (e.g., the front faces 230*a*, 230*b* face a common direction), a user may rotate the second structural component 200*b* (or the first structural component 200*a*) about a transverse axis (e.g., an axis orthogonal to a longitudinal axis of a structural component and extending between the first and second flanges or between two through-holes of a through-hole pair) of the second structural component 200*b* (or first structural component 200*a*) by 180 degrees such that the back faces 235*a*, 235*b* of the first and second structural components 200*a*, 200*b* face opposing directions and such that the first end 210*a* of the first structural component 200*a* is aligned with the second end 215*b* of the second structural component 200*b* (and the second end 215*a* of the first structural component 200*a* is aligned with the first end 210*b* of the second structural component 200*b*).

In another example, a user may rotate the second structural component 200*b* (or the first structural component 200*a*) about a longitudinal axis (e.g., an axis extending between the first and second ends of a structural component) of the second structural component 200*b* (or first structural component 200*a*) by 180 degrees such that the back faces 235*a*, 235*b* of the first and second structural components 200*a*, 200*b* face opposing directions. Those skilled in the art will recognize that in such examples, the first end 210*a* of the first structural component 200*a* becomes aligned with the first end 210*b* of the second structural component 200*b*, and the second end 215*a* of the first structural component 200*a* becomes aligned with the second end 215*b* of the second structural component 200*b*, however the first flange 250*a* of the first structural component 200*a* becomes aligned with the second flange 255*b* of the second structural component 200*b*, and the second flange 255*a* of the first structural component 200*a* becomes aligned with the first flange 250*b* of the second structural component 200*b* (rather than the arrangement shown in FIG. 3A, wherein the first flange 250*a* of the first structural component 200*a* is aligned with the first flange 250*b* of the second structural component 200*b*, and the second flange 255*a* of the first structural component 200*a* becomes aligned with the second flange 255*b* of the second structural component 200*b*).

Figure 3B:
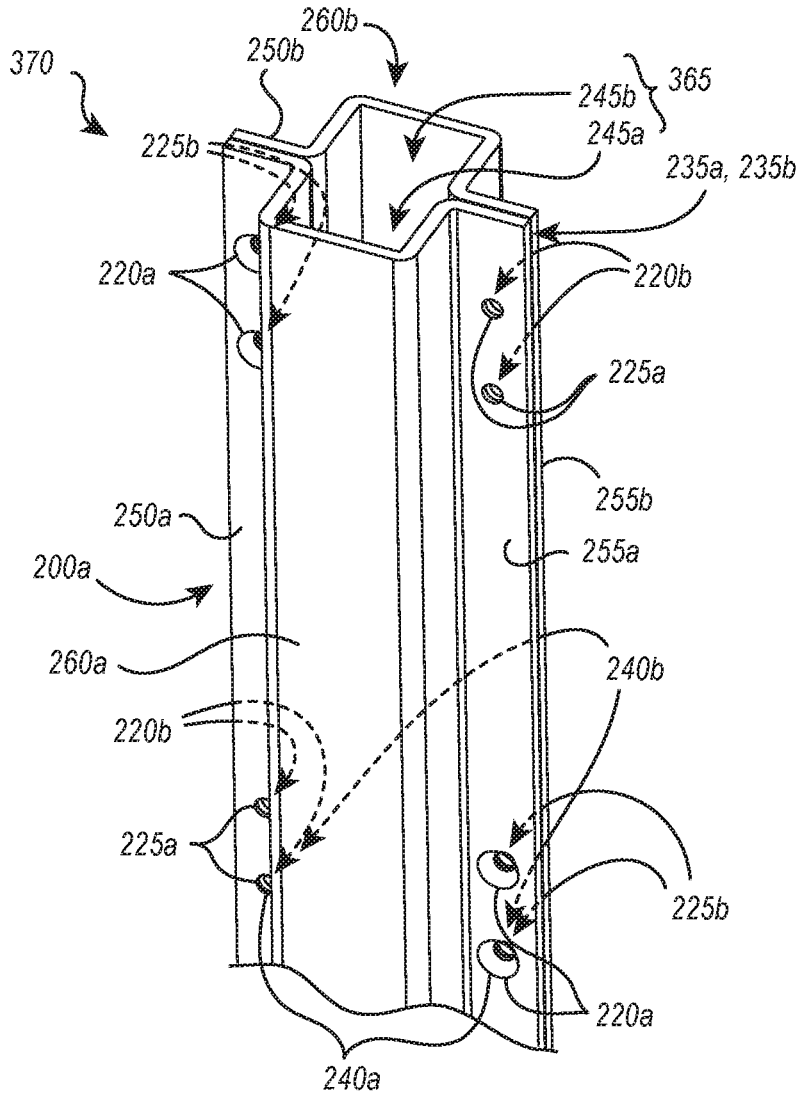
FIG. 3B illustrates a front perspective view of the two structural components shown in FIG. 3A joined together at respective back sides, in accordance with implementations of the present invention.

FIG. 3B illustrates a front perspective view of the first and second structural components 200*a*, 200*b* shown in FIG. 3A joined together, such that the back faces 235*a*, 235*b* of the first and second structural components 200*a*, 200*b* abut one another. In particular, as shown in FIG. 3B, the first and second flanges 250*a*, 255*a* of the first structural component 200*a* abut, respectively, the first and second flanges 250*b*, 255*b* of the second structural component 200*b*. As noted above with reference to FIG. 3A, the first and second structural components 200*a*, 200*b* are substantially identical, such that the positions of the countersunk through-holes 220*a* and the threaded through-holes 225*a* of the first structural component 200*a* along the longitudinal length of the first structural component 200*a* are substantially identical to the positions of the countersunk through-holes 220*b* and the threaded through-holes 225*b* of the second structural component 200*b* along the longitudinal length of the second structural component 200*b*. Furthermore, as mentioned above, the countersunk through-holes 220*a*, 220*b* and the threaded through-holes 225*a*, 225*b* of the first and second structural components 200*a*, 200*b* are arranged in through-hole pairs 240*a*, 240*b* of the first and second structural components 200*a*, 200*b*.

Accordingly, based at least in part on the arrangement of the countersunk through-holes 220*a*, 220*b* and the threaded through-holes 225*a*, 225*b* on the first and second structural components 200*a*, 200*b* described above, when the back faces 235*a*, 235*b* of the first and second structural components 200*a*, 200*b* abut one another in the manner shown in FIG. 3B, each countersunk through-hole 220*a* (e.g., each countersunk through-hole 220*a* of a through-hole pair 240*a*) of the first structural component 200*a* aligns with a threaded through-hole 225*b* (e.g., a threaded through-hole 225*b* of a through-hole pair 240*b*) of the second structural component 200*b*. Similarly, when the back faces 235*a*, 235*b* of the first and second structural components 200*a*, 200*b* abut one another, each countersunk through-hole 220*b* (e.g., each countersunk through-hole 220*b* of a through-hole pair 240*b*) of the second structural component 200*b* aligns with a threaded through-hole 225*a* (e.g., a threaded through-hole 225*a* of a through-hole pair 240*a*) of the first structural component 200*a*.

Thus, when back faces 235*a*, 235*b* of the first and second structural components 200*a*, 200*b* abut one another in the manner shown in FIG. 3B, each of the countersunk through-holes 220*a*, 220*b* are configured to receive a screw (e.g., screws with a tapered head). A manufacturer or assembler can pass each of the screws through a countersunk through-hole 220*a*, 220*b* toward the threaded through-hole 225*a*, 225*b* to which the countersunk through-hole 220*a*, 220*b* is aligned to thread into the threaded through-hole 225*a*, 225*b*, thereby securing the first structural component 200*a* to the second structural component 200*b*. When secured together (e.g., in the manner described herein), the first and second structural components 200*a*, 200*b* may form a single vertical structure (e.g., referred to sometimes herein as a joined pair of structural components 370) for implementation into a modular wall system (e.g., for connecting to one or more horizontal connection components and/or wall tiles, as indicated in FIGS. 1A and 1B).

Those skilled in the art will appreciate that the countersinking features of the countersunk through-holes 220*a*, 220*b* may be designed such that a tapered screw inserted through a countersunk through-hole 220*a*, 220*b* may be flush with the front face 230*a*, 230*b* of the flange 250*a*, 255*a*, 250*b*, 255*b* upon which the countersunk through-hole 220*a*, 220*b* is disposed when the tapered screw is threaded into the threaded through-hole 225*a*, 225*b* aligned with the countersunk-through-holes.

By way of further explanation, FIG. 3B also shows that when first structural components 200*a* joins with the second structural component 200*b* (e.g., by threading screws through the countersunk through-holes 220*a*, 220*b* into threaded through-holes 225*a*, 225*b* aligned with the countersunk through-holes 220*a*, 220*b*), the channel 245*a* of the first structural component 200*a* faces the channel 245*b* of the second structural component 200*b* to form an elongated cavity 365 between the first structural component 200*a* and the second structural component 200*b*. Accordingly, when in a joined configuration, as shown in FIG. 3B, the protruding portion 260*a* of the first structural component 200*a* and the protruding portion 260*b* of the second structural component 200*b* extend away from one another (e.g., in opposite directions). As such, the joined pair of structural components 370 may securely attach to horizontal connection components on at least two sides of the joined pair of structural components, as will be described in more detail hereinbelow.

In view of the foregoing, the structural component 200 shown in FIG. 2 is a reversible structural component, wherein separate but identical structural components may be reversely oriented and joined to one another such that back sides of each identical structural component abut one another to align threaded through-holes of one structural component with countersunk through-holes of the other, and vice versa. The countersunk through-holes of the joined structural components may receive screws (e.g., screws with tapered heads) that extend through the countersunk through-holes into the threaded through-hole of the opposing structural component to which the countersunk through-hole is aligned. In this regard, separate portions of a composite structural component (e.g., a vertical component) of a modular wall system may be constructed, advantageously, with separate but identical constituent structural components.

Figure 4:
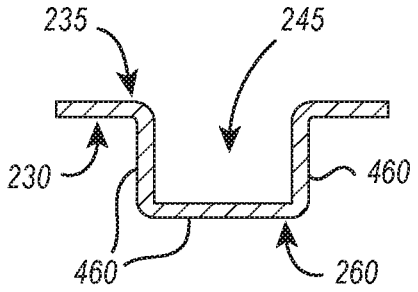
FIG. 4 illustrates a top view of a structural component of a modular wall system, in accordance with implementations of the present invention.

FIG. 4 illustrates a top view of a structural component 200 that is implementable into modular wall system (e.g., to form one or more vertical structures composed of joined pairs of structural components for attachment to other components of modular wall systems). For clarity, FIG. 4 omits at least some reference labels for features and/or elements of the structural component 200 shown and/or described in other Figures. As mentioned hereinabove, in some embodiments, the structural component 200 includes a channel 245 on the back face 235 thereof extending along the elongated body 205 of the structural component 200. The presence of the channel 245 creates a protruding portion 260 with multiple faces 460, and one or more of the multiple faces 460 of the protruding portion 260 may, in some implementations, interface with one or more surfaces of a horizontal connection component (see FIGS. 6A-6B, 8). Advantageously, in some implementations, the interfacing between the surface(s) of the horizontal connection component and the multiple faces 460 of the protruding portion 260 may provide support against lateral forces in a modular wall structure.

As is evident from the top view of the structural component 200 shown in FIG. 4, the channel 245 causes the structural component 200 to have a generally U-shaped profile, but those skilled in the art will recognize that other designs, profiles and/or configurations of the structural component 200 are within the scope of this disclosure. For example, a structural component 200 may include a substantially X-shaped, Y-shaped, V-shaped, T-shaped, I-shaped, H-shaped, and/or other form, provided that the structural component 200 includes flanges and/or other surfaces upon which through-holes (e.g., countersunk through-holes and threaded through-holes) may be disposed such that through-holes of a second structural component may reversibly align with the through-holes of the structural component 200. Furthermore, in some implementations, a structural component 200 includes a plurality of adjacently arranged channels (e.g., adjacently arranged U-shaped channels).

One will appreciate that various shapes of a structural component 200 may provide a protruding portion (e.g., protruding portion 260). As such, when the structural component 200 is combined with a separate identical structural component to form a joined pair of structural components, a pair of protruding portions extends from opposing sides of the joined pair of structural components for engagement with surfaces of one or more horizontal connection components. However, it should be noted that in some implementations, a structural component 200 includes no channel and/or protrusions. Accordingly, the structural component 200 can be composed of a substantially flat elongated body of material that is configured to reversibly engage with a separate but identical structural component.

Furthermore, those skilled in the art will recognize in view of the present specification and claims that, although FIG. 4 depicts the channel 245 as extending along the entire longitudinal length of the structural component 200 (e.g., along the full length of the elongated body 205 between the first end 210 and the second end 215), a channel 245 of a structural component 200 may, in some embodiments, extend only along a portion of the longitudinal length of the structural component. One will further appreciate, however, that a manufacturer, builder, and/or designer may achieve a simplified molding/extrusion process by causing the channel 245 to extend along the entire longitudinal length of the structural component 200.

Accordingly, one will appreciate in view of the present specification and claims that different shapes of reversible structural components for use in a modular wall structure (e.g., to form a composite vertical structure comprising a joined pair of structural components), as well as configurations/arrangements of countersunk and threaded through-hole pairs can facilitate attachment of pairs of reversible structural components. However, a structural component of the present disclosure may include one or more additional through-holes not explicitly shown in FIGS. 1A-4, such as to facilitate attachment between a structural component as described hereinabove and a horizontal connection component.

Figure 5A:
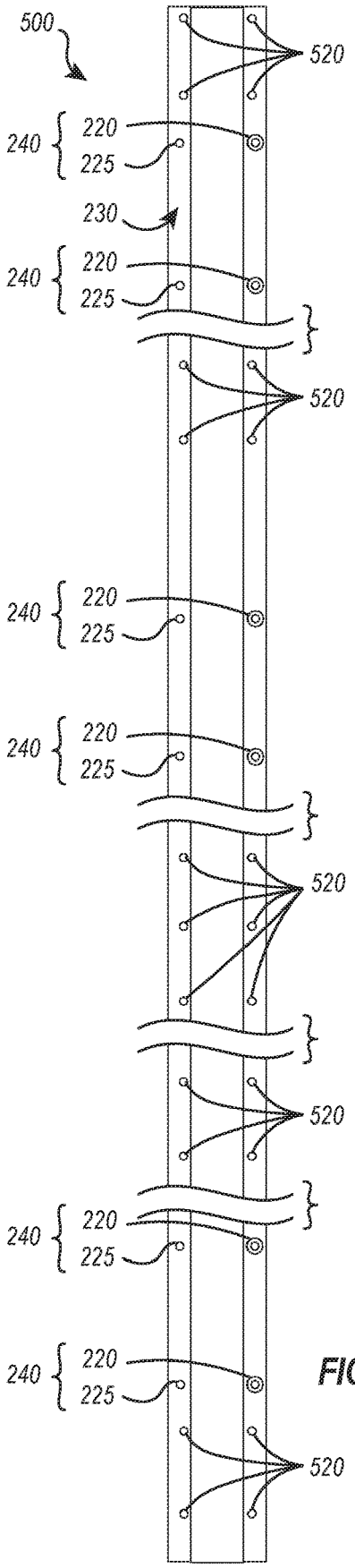
FIGS. 5A and 5B illustrate, respectively, front and rear views of an example of a structural component of a modular wall system, in accordance with implementations of the present invention.
Figure 5B:
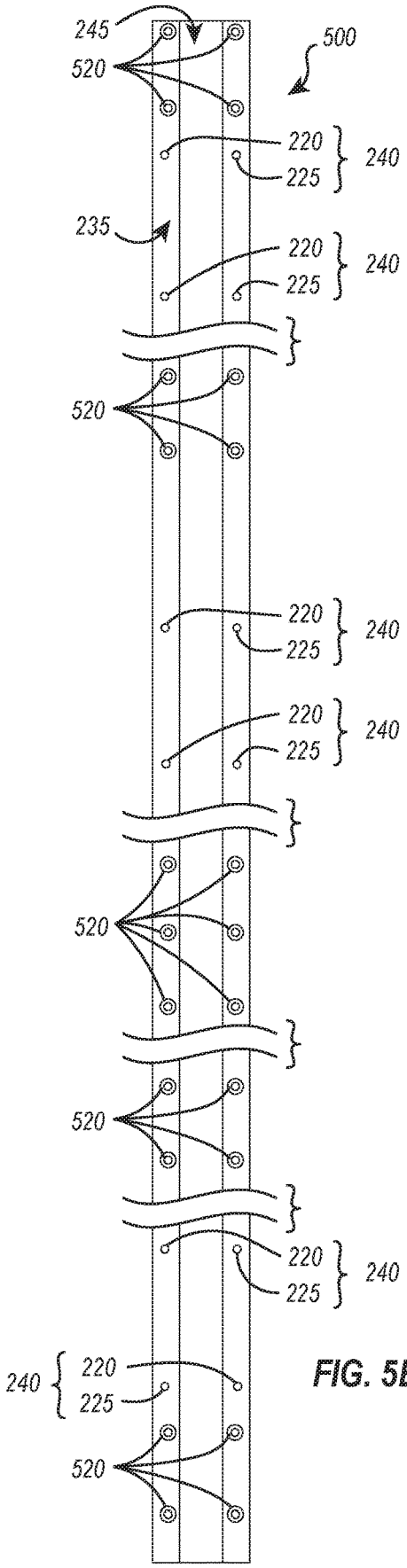

FIGS. 5A and 5B illustrate, respectively, front and rear views of an example of a structural component 500 that is implementable into a modular wall system. As is evident in FIG. 5A, the structural component 500 includes a plurality of through-hole pairs 240 that each include a threaded through-hole 225 and a countersunk through-hole 220 that is countersunk from the front face 230 of the structural component 500 (e.g., the side of the structural component that is opposite to the channel 245, shown in FIG. 5B).

As shown in FIG. 5B, the structural component 500 includes a plurality of additional countersunk through-holes 520. For example, FIG. 5B shows that the additional countersunk through-holes 520 are countersunk from the back face 235 of the structural component 500 (e.g., opposite to the front face 230). FIG. 5B also depicts that the additional countersunk through-holes 520 are disposed on and extending through both the first flange 250 and the second flange 255 of the structural component 500. In some implementations, the countersunk through-holes 220 and the additional countersunk through-holes 520 have common countersinking features (e.g., diameter, angle), which may provide a simplified manufacturing process for users.

Those skilled in the art will recognize that the particular number and arrangement of through-holes of the structural component 500 shown in FIGS. 5A and 5B is illustrative only and non-limiting. For instance, the present Figures illustrate the structural component 500 with a number of break lines, indicating that the total longitudinal length of a structural component the number of through-holes (e.g., through-hole pairs including a countersunk through-hole and a threaded through-hole as well as additional through-hole pairs including pairs of countersunk through-holes) may vary in different embodiments and/or implementations.

One will recognize that because the additional countersunk through-holes 520 are countersunk from the back face 235 of the structural component 500, the additional countersunk through-holes 520 do not become aligned, in the particular manner described hereinabove related to the through-hole pairs 240, with through-holes of another separate identical structural component 500 when both structural components are arranged 180 degrees with respect to one another and with their respective back faces 235 brought into abutment. In particular, when one structural component 500 combines with another to form a joined pair of structural components, the additional countersunk through-holes 520 become directed outward from the joined pair of structural components. Thus, in this case, screws inserted through the additional countersunk through-holes 520 extend outward from the joined pair of structural components in opposite directions. In some instances, outward-facing screws extending from the additional countersunk through-holes 520 act as fasteners for securing a structural component 500 to one or more horizontal connection components (e.g., by threading into a threaded hole of a horizontal connection component).

Figure 6A:
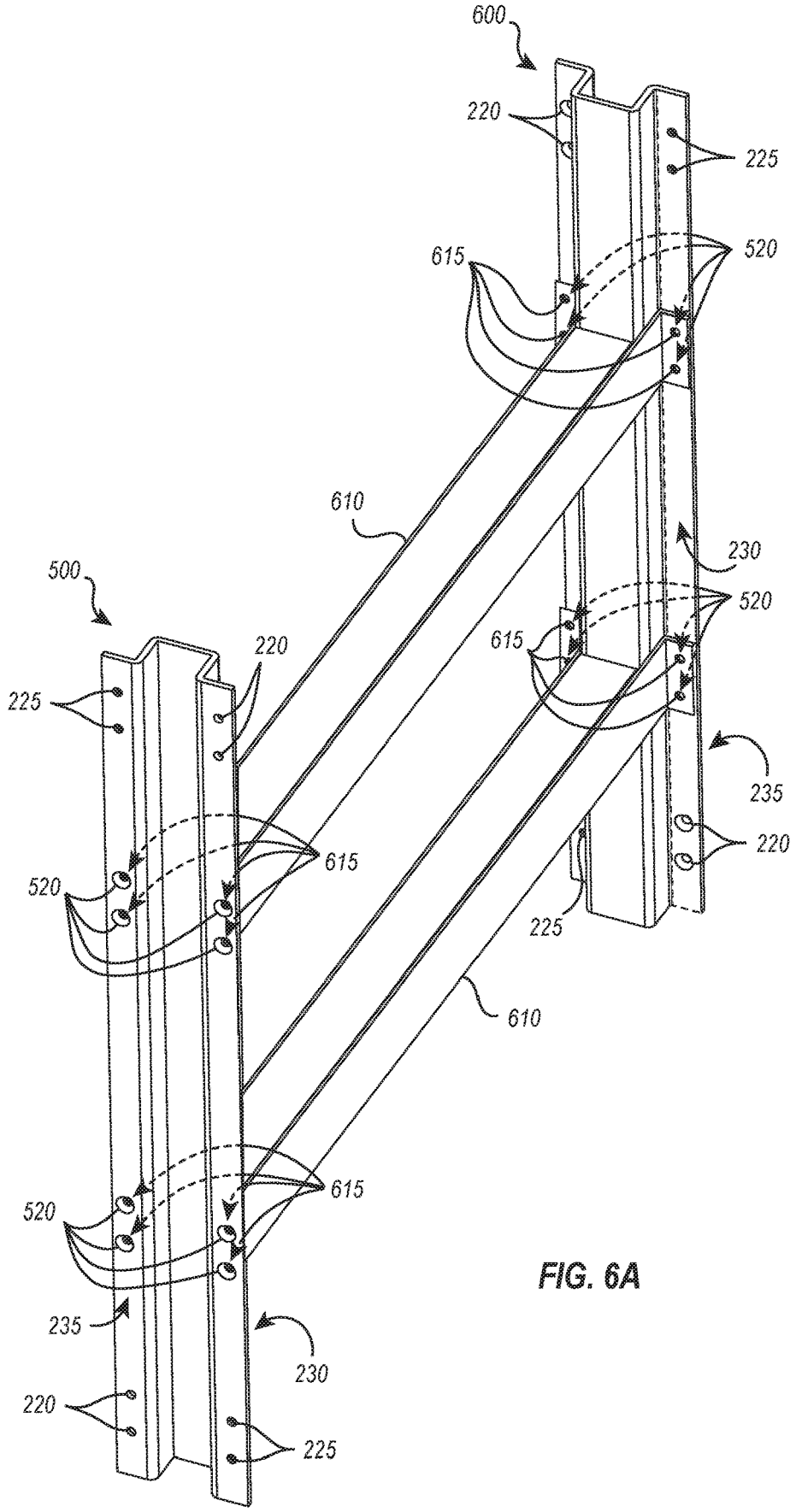
FIG. 6A illustrates two structural components joined to a horizontal connection component, in accordance with implementations of the present invention.
Figure 6B:
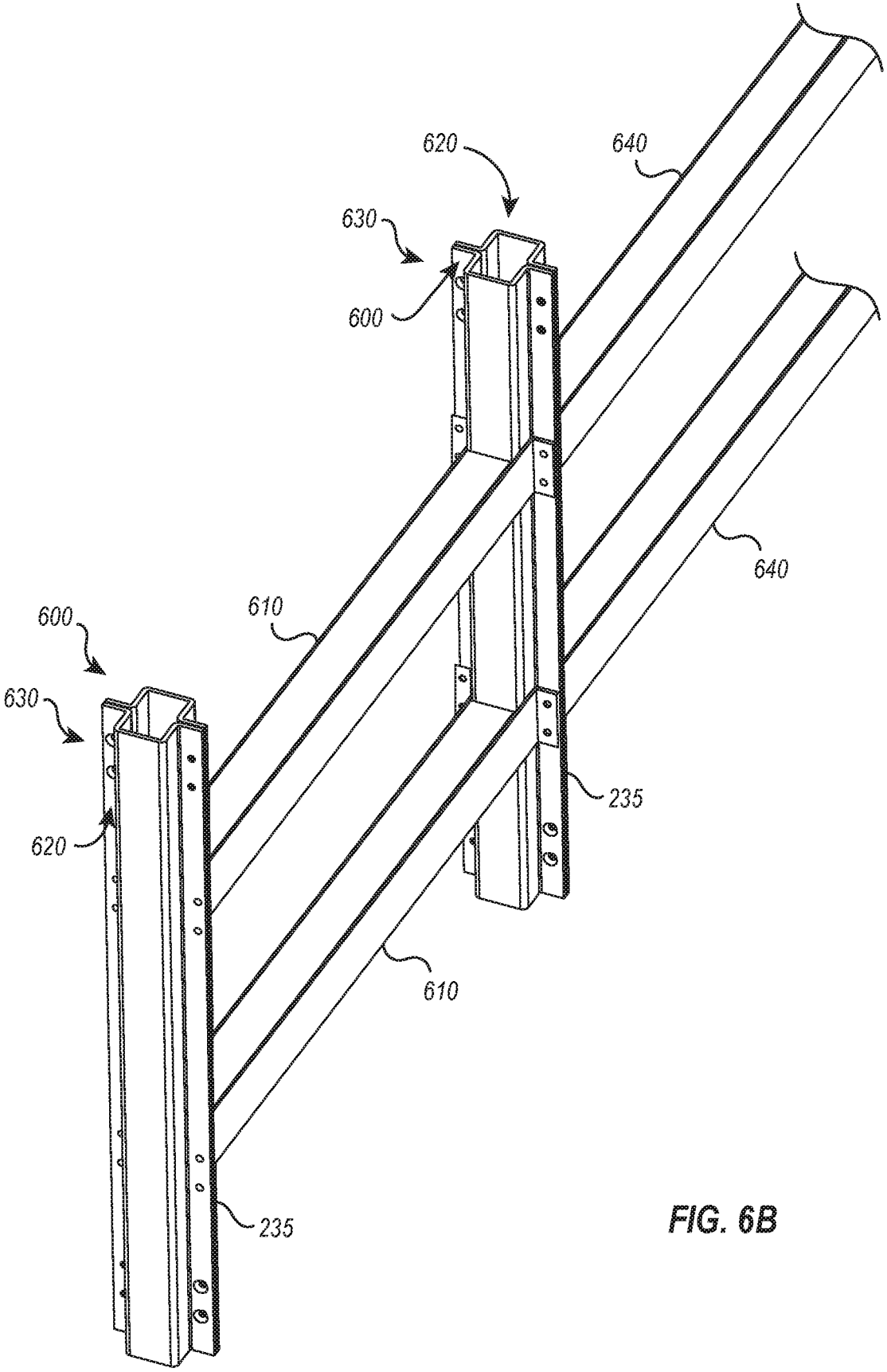
FIG. 6B illustrates the two structural components of FIG. 6A joined to additional structural components, in accordance with implementations of the present invention.

FIGS. 6A and 6B describe further details related to the functionality of securing to horizontal connection components. For example, FIG. 6A illustrates two structural components 600 joined to horizontal connection components 610. One will appreciate that the structural components 600 correspond to the structural component 500 illustrated in and described with reference to FIGS. 5A and 5B. This is, in particular, because the structural components 600 include a plurality of through-hole pairs (including threaded through-holes 225 and countersunk through-holes 220 that are countersunk from the front faces 230 of the structural components 600) and a plurality of additional countersunk through-holes 520 that are countersunk from the back faces 235 of the structural components 600. FIG. 6A further shows that the structural components 600 are vertically disposed and arranged such that the front faces 230 of the structural components 600 face one another.

Additionally, FIG. 6A shows that the horizontal connection components 610 extend between the front faces 230 of the structural components 600. As depicted in FIG. 6A, the horizontal connection components 610 include a plurality of threaded holes 615. The threaded holes 615 of the horizontal connection components 610 are configured to align with the additional countersunk through-holes 520 of the structural components 600. As such, in the configuration depicted in FIG. 6A, the additional countersunk through-holes 520 may receive screws that advance through the additional countersunk through-holes 520 and thread into the threaded holes 615 of the horizontal connection components 610 to which the additional countersunk through-holes 520 are aligned (the screws are omitted from the Figures to clearly depict the character of the various through-holes illustrated in the Figures).

Accordingly, in at least some implementations, one or more structural components 600 affix to one or more horizontal connection components 610 to form a structural frame of a modular wall system (e.g., corresponding to the combinations of vertical structural components 110 and horizontal connection components 120 illustrated in FIGS. 1A and 1B). One will recognize that the horizontal connection components 610 may include one or more attachment features for removably securing a modular wall tile (e.g., FIG. 1) to one or more sides of the horizontal connection component (these features are not depicted in FIG. 6A, 6B, or 8 to focus on the aspects and features of the presently disclosed structural components).

Although the threaded holes 615 of the horizontal connection components are illustrated in FIGS. 5A-6B as through-holes, it will be appreciated that the additional countersunk through-holes 520 of the structural components 600 may align with any threaded hole of a horizontal connection component 610 to facilitate connection thereto when the additional countersunk through-hole 520 receives a screw that threads into the threaded hole of the horizontal connection component 610.

As noted earlier regarding the countersunk through-holes 220, the countersinking features of the countersunk through-holes 220 (e.g., the angle and the diameter of the countersunk through-holes 220) may allow a tapered screw inserted through a countersunk through-hole 220 to be flush with the front face 230 upon which the countersunk through-hole is disposed. Similarly, the countersinking features of the additional countersunk through-holes 520 may allow a tapered screw inserted through an additional countersunk through-hole to be flush with the back face 235 upon which the additional countersunk through-hole 520 is disposed.

FIG. 6B illustrates the two structural components 600 of FIG. 6A joined to additional structural components 620. The additional structural components 620 are identical to the structural components 600, and each additional structural component 620 is arranged 180-degrees relative to a corresponding structural component 600 to which the additional structural component 620 is joined to form joined pairs of structural components 630. As described above (see FIG. 3B), the back faces 235 of the structural components 600, 620 of a joined pair of structural components 630 abut one another. In some embodiments, the screws used to affix the structural components 600 to the horizontal connection components 610 become flush with the back face 235 of the structural components 600 when the screws are threaded into the threaded holes 615 of the horizontal connection components 610. Accordingly, one will appreciate that the back faces of the structural components 600, 620 may abut one another without being obstructed by the screws utilized to affix the structural components 600 to the horizontal connection components 610. In some implementations, a user affixes one or more of the additional structural components 620 to one or more additional horizontal connection components 640 before joining the one or more additional structural components 620 to structural components 600, as shown in FIG. 6B.

In this manner, a user may connect parallel, spaced apart structural components 600 to opposing ends of one or more horizontal connection components 610. The user may then join the structural components 600 to additional structural components 620 to form joined pairs of structural components 630, and the additional structural components 620 are, in some instances, already affixed to other horizontal connection components 640 before being joined with the structural components 600. As indicated above, in some embodiments, the screws utilized to affix the various horizontal connection components to the various structural components and the screws utilized to form joined pairs of structural components may be of the same type. This can advantageously reduce the number of different types of fastening elements used in modular wall systems to affix various components to one another.

Although FIGS. 6A and 6B illustrate each of the structural components 600, 620 as being identically sized, those skilled in the art will appreciate that, in some implementations, the structural components have different longitudinal lengths. As such, some structural components can stand taller than others when vertically disposed (while still allowing the through-hole pairs of the structural components to align 600, 620). For example, manufacturers and/or designers may utilize structural components of different lengths to accommodate different interior structures (e.g., to partition a space that includes a mezzanine structure). Furthermore, FIG. 6B illustrates break lines on the additional horizontal connection components 640, indicating that the horizontal connection components may have any length and that different horizontal connection components may have differing lengths. For instance, one horizontal connection component may extend from an initial structural component to an adjacent structural component that is shorter in longitudinal length than the initial structural component, and a second horizontal connection component may extend from the initial structural component to a subsequent structural component (over the top of the adjacent structural component) that is further from the initial structural component than the adjacent structural component. and different lengths.

Additionally, one will appreciate that FIG. 6B shows that a joined pair of structural components 630 forms an end of a structural frame, however, in some instances, a single vertically disposed structural component forms an end of the structural frame (e.g., as illustrated in FIG. 6A), rather than a joined pair of structural components 630. Accordingly, the presently disclosed structural components are versatilely implementable into modular wall structures to form structural frames as joined pairs of structural components or as single structural components (e.g., to provide a slimmer aesthetic for ends of structural frames).

Furthermore, one will appreciate that the exemplary arrangement of additional countersunk through-holes shown in FIGS. 5A-6B are illustrative and non-limiting. In FIGS. 5A-6B, the additional countersunk through-holes are disposed on the various structural members in transversely aligned pairs, similar to the arrangement of the through-hole pairs comprising a countersunk through-hole and a threaded through-hole described hereinabove.

Figure 7A:
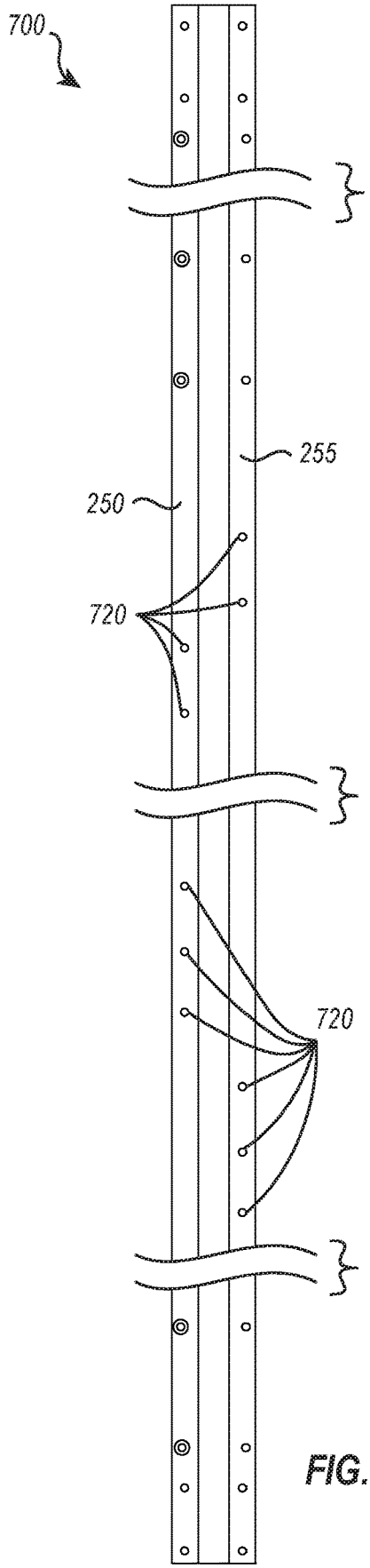
FIGS. 7A and 7B illustrate, respectively, front and rear views of another example of a structural component of a modular wall system, in accordance with implementations of the present invention.
Figure 7B:
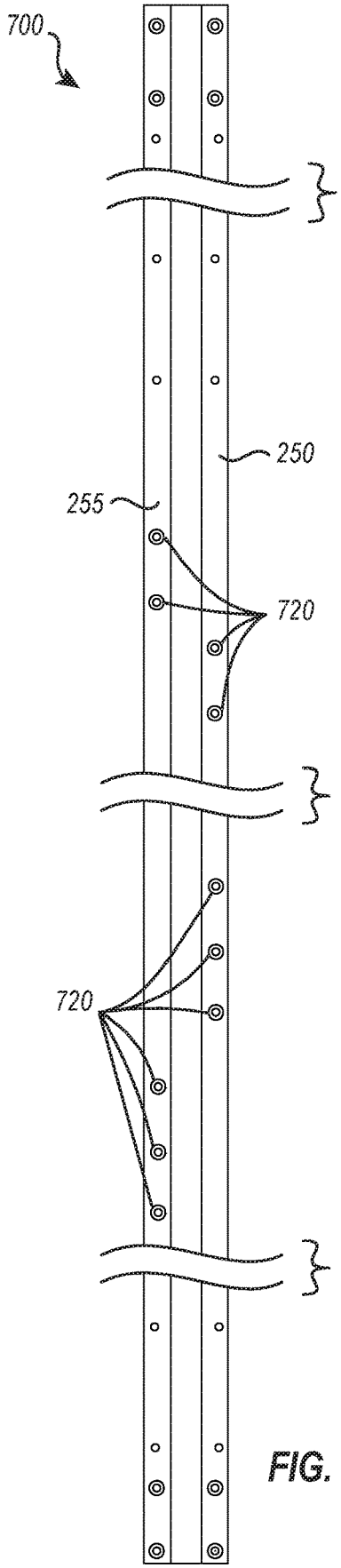

FIGS. 7A-7B show front and rear views, respectively, of an alternative embodiment of a structural component 700. For example, FIGS. 7A-7B show that at least some of the additional countersunk through-holes 720 can be disposed on the back face 235 of the first and second flanges 250, 255 along the longitudinal length of the structural component 700, such that the additional countersunk through-holes 720 do not form transversely aligned pairs. Rather, each of the additional countersunk through-holes 720 can be positioned on the structural component 700 without a corresponding transversely aligned additional countersunk through-hole 720 on an opposing flange.

Figure 8:
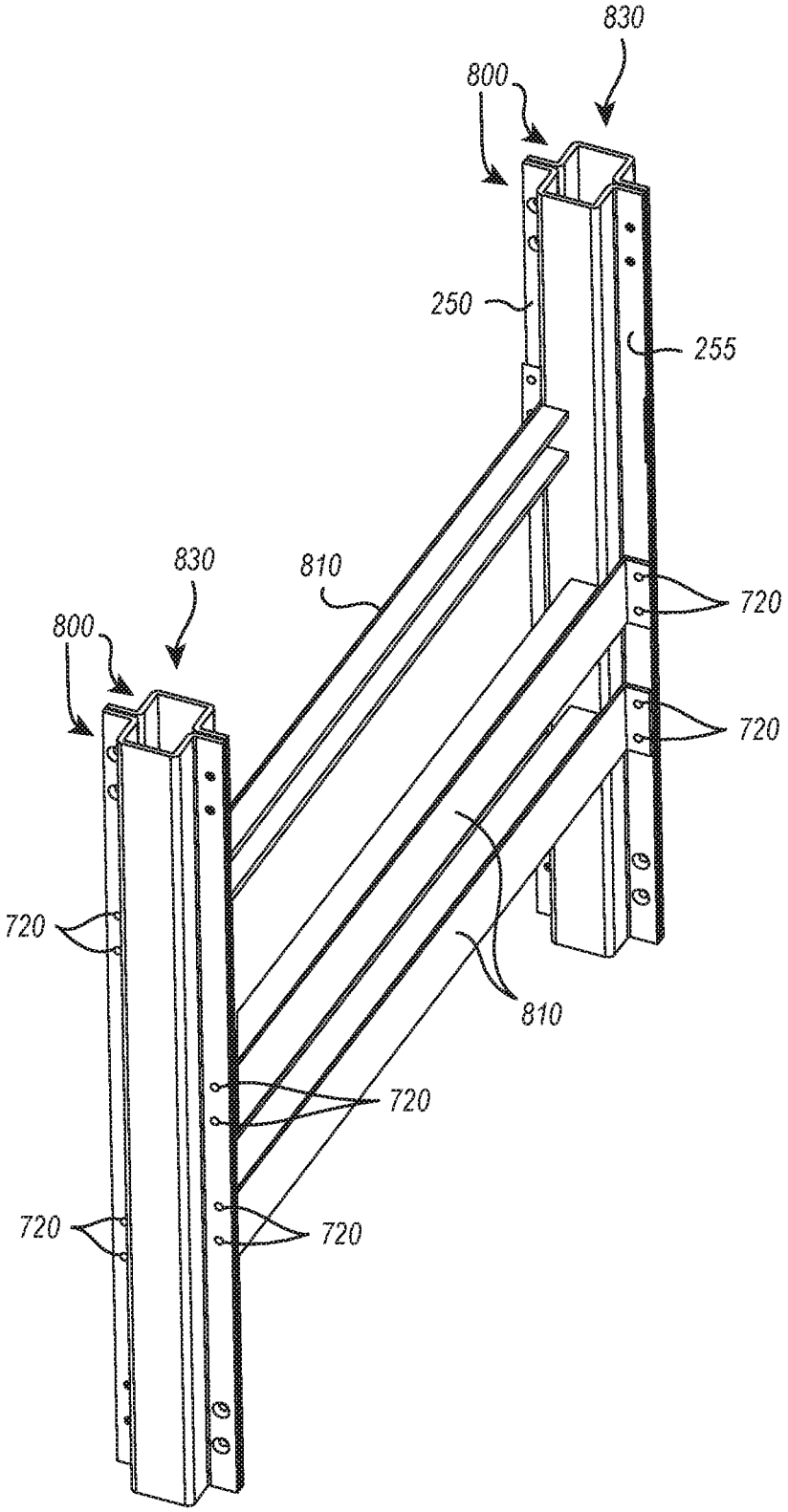
FIG. 8 illustrates an example of a plurality of structural components joined to a plurality of horizontal connection components, in accordance with implementations of the present invention.

FIG. 8 illustrates structural components 800 with unaligned additional countersunk through-holes 720 (as shown in FIGS. 7A-7B) implemented into a modular wall structure as joined pairs of structural components 830. As shown, because at least some of the additional countersunk through-holes 720 on the first flange 250 are unaligned with at least some of the additional countersunk through-holes 720 on the second flange 255 of the various structural components 800, the various structural components 800 may affix at their first flange 250 to horizontal connection components 810 at one height and may affix at their second flange 255 to horizontal connection components 810 at a different height. Accordingly, in some embodiments, the structural components 800 are implemented into a modular wall structure to secure horizontal connection components 810 at different heights on opposing sides of the modular wall structure. The horizontal connection components 810 on the different sides of the modular wall structure may then removably secure wall tiles of different sizes and/or at different heights to advantageously provide for different aesthetics on different sides of the modular wall structure.

Those skilled in the art will recognize that a structural component may include any combination of additional countersunk through-hole (e.g., countersunk from the back side of the structural component) for facilitating affixation to horizontal connection components. For example, a structural component may include at least two additional countersunk through-holes that are transversely aligned on the structural component and at least one additional countersunk through-hole that is not transversely aligned with another additional countersunk through-hole.

Additionally, the foregoing description has described various through-holes for receiving screws to affix structural components to one another and/or to horizontal connection components. One will appreciate, however, that a structural component may include other through-holes not shown in FIGS. 1A-8 for affixing structural components to horizontal connection components. For instance, referring again to FIG. 4, in some embodiments, a structural component 200 includes one or more additional countersunk and/or threaded through-holes in one or more of the multiple faces 460 of the protruding portion 260 of the structural component 200. By way of non-limiting example, a structural component can include another countersunk or threaded through-hole one or more of the multiple faces 460 of the protruding portion 260 to receive a screw that aligns with a corresponding threaded or countersunk hole of a horizontal connection component to provide additional support to secure the horizontal connection component to the structural component 200.

Although the Figures focus on implementations in which the structural components are vertically disposed when implemented into a modular wall structure, those skilled in the art will recognize that other configurations are within the scope of this disclosure. For instance, in some implementations, the presently disclosed structural components are horizontally disposed when arranged in a modular wall structure, and the components referred to herein as "horizontal connection components" are vertically disposed when connected to the structural components.

The various components of modular wall systems described herein, including the various implementations of structural components, may be made of any suitable material that provides enough strength for structural support within a wall structure. Such materials may include metals, polymers, and/or other materials generally known and used in the art. In one exemplary implementation, the structural components described herein comprise cold-rolled steel. Cold-rolled steel may provide advantages because of its ability to provide a fire-rated modular wall system, as opposed to a material such as aluminum, which may not be fire-rated. However, in other instances, aluminum, or other non-fire rated materials, are used to form the structural components described herein. For instance, a manufacturer or designer may desire to take advantage of other advantageous properties of aluminum or other materials, such as reduced weight and/or improved extrudability.

Additionally, those skilled in the art will recognize that the particular, sizes, ratios, and/or shapes depicted in the Figures are illustrative only and non-limiting, and those skilled in the art may practice principles described herein under various implementation circumstances and/or configurations. For example, in one implementation, the various countersunk through-holes of the presently disclosed structural components have a diameter of 4.76 mm and are countersunk at an angle of 41 degrees (e.g., sized to fit #10 flat head mechanical screws) and the threaded through-holes have a tap size of #10-24 and a diameter of 3.73 mm, but other hole and/or screw sizes are within the scope of this disclosure. In another example implementation, the presently disclosed structural components are extruded from a material with a thickness of 2.67 mm, but any particular thickness, length, width, depth, height, and/or size of any aspect of a presently disclosed structural component is within the scope of this disclosure.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

It will also be appreciated that systems, devices, products, kits, methods, and/or processes, according to certain embodiments of the present disclosure may include, incorporate, or otherwise comprise properties, features (e.g., components, members, elements, parts, and/or portions) described in other embodiments disclosed and/or described herein. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed is:

1. A reversible structural component for use as a portion of a vertical frame in a modular wall system, comprising:

an elongate body extending between a first end and a second end thereof;

a plurality of countersunk through-holes extending through the reversible structural component; and a plurality of threaded through-holes extending through the reversible structural component;

wherein:

the countersunk through-holes and the threaded through-holes are disposed on the elongate body between the first end and the second end so that the countersunk through-holes of the reversible structural component are aligned with the threaded through-holes of a separate identical reversible structural component when back sides of the reversible structural component and the separate identical reversible structural component are brought together 180-degrees relative to one another during use.

2. The reversible structural component of claim 1, further comprising a channel extending longitudinally along the reversible structural component from the first end to the second end.

3. The reversible structural component of claim 2, further comprising two opposing flanges extending outward from the channel.

4. The reversible structural component of claim 3, wherein at least one of the plurality of countersunk through-holes extends through at least one of the flanges and at least one of the plurality of threaded through-holes extends through at least one of the flanges.

5. The reversible structural component of claim 2, wherein the plurality of countersunk through-holes are countersunk from a front side of the reversible structural component, the front side being opposite the channel.

6. The reversible structural component of claim 1, further comprising a second plurality of countersunk through-holes.

7. The reversible structural component of claim 6, wherein the second plurality of countersunk through-holes are countersunk from the back side of the reversible structural component, the back side being on a same side as a channel extending longitudinally along the elongate body.

8. The reversible structural component of claim 6, wherein:

at least one of the second plurality of countersunk through-holes extends through at least one flange of the reversible structural component, the at least one flange extending from a channel that extends longitudinally along the elongate body;

at least one of the second plurality of countersunk through-holes is configured to align with a threaded hole of a horizontal connection component;

at least one of the second plurality of countersunk through-holes is configured to receive a first type of screw to secure the reversible structural component to the horizontal connection component; and the plurality of countersunk through holes and the plurality of threaded through-holes are configured to receive the first type of screw to secure the reversible structural component to the separate identical reversible structural component.

9. A vertical frame for use in a modular wall system, comprising:

a first structural component and a second structural component, each of the first and second structural components comprising:

an elongated body including a front side and a back side; and a through-hole pair, the through-hole pair comprising:

a countersunk through-hole and a threaded through-hole, the countersunk through-hole and the threaded through-hole being offset from one another;

wherein when the back side of the first structural component abuts the back side of the second structural component:

the countersunk through-hole of the through-hole pair of the first structural component becomes aligned with the threaded through-hole of the through-hole pair of the second structural component; and the threaded through-hole of the through-hole pair of the first structural component becomes aligned with the countersunk through-hole of the through-hole pair of the second structural component.

10. The vertical frame of claim 9, wherein the first and second structural components further comprise: a channel extending longitudinally along the elongated body.

11. The vertical frame of claim 10, wherein the first and second structural components further comprise: a first flange and a second flange, both the first flange and the second flange extending outward from the channel.

12. The vertical frame of claim 11, wherein:

the countersunk through-hole of each of the first and second structural components is positioned on the first flange; and the threaded through-hole of each of the first and second structural components is positioned on the second flange.

13. The vertical frame of claim 10, wherein the countersunk through-hole of each of the first and second structural components is countersunk from the front side of the elongated body, the front side being opposite the channel.

14. The vertical frame of claim 9, wherein each of the first and second structural components further comprises a plurality of through-hole pairs.

15. The vertical frame of claim 14, wherein for the first and second structural components:

at least one countersunk through-hole of the plurality of through-hole pairs is positioned on a first flange extending outward from a channel that extends along the elongated body;

at least one countersunk through-hole of the plurality of through-hole pairs is positioned on a second flange extending outward from the channel;

at least one threaded through-hole of the plurality of through-hole pairs is positioned on the first flange; and at least one threaded through-hole of the plurality of through-hole pairs is positioned on the second flange.

16. The vertical frame of claim 11, wherein each of the first and second structural components further comprises:

an additional plurality of countersunk through-holes disposed on the first flange or the second flange, wherein:

the additional countersunk through-holes of the additional plurality of countersunk through-holes are countersunk from the back side of the elongated body, the back side being opposite the front side.

17. A modular wall, comprising:

at least a first and a second elongate structural component joined together 180-degrees relative to one another at respective back sides thereof, each elongate structural component comprising a plurality of countersunk through-holes extending therethrough and a plurality of threaded through-holes extending therethrough;

wherein positions of each of the plurality of countersunk through-holes and positions of each of the plurality of threaded through-holes are the same along a length of each of the first and second elongate structural components, respectively, so that:

the countersunk through-holes of each of the first and second elongate structural components are aligned with the threaded through-holes of the other elongate structural component to which it is joined; and the threaded through-holes of each of the first and second elongate structural components are aligned with the countersunk through-holes of the other elongate structural components to which it is joined;

a horizontal connection component affixed to the first elongate structural component, comprising an attachment feature for receiving a modular wall tile; and the modular wall tile attached to the attachment feature.

18. The modular wall of claim 17, wherein each of the first and second elongate structural components have a first end and a second end, wherein the first end of the first elongate structural component is aligned with the second end of the second elongate structural component.

19. The modular wall of claim 17, further comprising at least third and fourth elongate structural components joined together 180-degrees relative to one another at respective back sides thereof, the third and fourth elongate structural components forming a second pair of joined elongate structural components disposed spaced apart from and parallel to a first pair of elongate structural components, the first pair of elongate structural components comprising the first and second joined elongate structural components.

20. The modular wall of claim 19, wherein the horizontal connection component is further affixed to the third elongate structural component.

* * * * *